US009581308B2

(12) United States Patent
Watkins

(10) Patent No.: US 9,581,308 B2
(45) Date of Patent: Feb. 28, 2017

(54) LENS FOR LED TRAFFIC LIGHTS

(71) Applicant: FORTRAN TRAFFIC SYSTEMS LIMITED, Toronto (CA)

(72) Inventor: Edward T. Watkins, Toronto (CA)

(73) Assignee: FORTRAN TRAFFIC SYSTEMS LIMITED, Toronto, Ontario (CA)

( * ) Notice: Subject to any disclaimer, the term of this patent is extended or adjusted under 35 U.S.C. 154(b) by 0 days.

(21) Appl. No.: 14/798,600

(22) Filed: Jul. 14, 2015

(65) Prior Publication Data

US 2017/0016590 A1 Jan. 19, 2017

(51) Int. Cl.

| | |
|---|---|
| ***F21V 5/04*** | (2006.01) |
| ***G08G 1/095*** | (2006.01) |
| *F21Y 101/02* | (2006.01) |
| *F21W 111/02* | (2006.01) |

(52) U.S. Cl.

CPC ..... *F21V 5/048* (2013.01); *G08G 1/095* (2013.01); *F21W 2111/02* (2013.01); *F21Y 2101/02* (2013.01)

(58) Field of Classification Search

CPC ..... G08G 1/095; F21V 5/048
USPC ..... 362/335
See application file for complete search history.

(56) References Cited

U.S. PATENT DOCUMENTS

D215,484 S * 10/1969 Farron ..... D26/123
4,425,608 A * 1/1984 Hecker ..... G09F 13/28 362/290
5,014,165 A * 5/1991 Naganawa ..... F21S 48/1233 362/309
5,782,555 A * 7/1998 Hochstein ..... B60Q 1/2696 362/294
6,447,145 B1 * 9/2002 Thomas ..... F21S 8/02 362/105
6,509,840 B2 * 1/2003 Martineau ..... F21V 5/04 340/815.45
7,434,968 B2 * 10/2008 Wu ..... F21V 23/02 340/815.45
8,104,930 B2 * 1/2012 Zhang ..... F21V 5/04 362/311.01
8,272,767 B2 * 9/2012 Chen ..... F21V 5/04 359/642
8,292,474 B2 * 10/2012 Ho ..... F21V 5/04 362/311.02
8,310,404 B2 * 11/2012 Kishimoto ..... G08G 1/095 343/720
8,500,309 B2 * 8/2013 Chang ..... F21V 5/048 362/311.02
9,064,410 B2 * 6/2015 Hatano ..... G08G 1/095

OTHER PUBLICATIONS

Jp2006202114, all areas, Jan. 21, 2005.*

* cited by examiner

*Primary Examiner* — Anabel Ton

(57) ABSTRACT

A lens for preventing the build-up of snow and ice on LED traffic lights. The lens is hollow and fits over the LED signal beacon of the traffic light. The lens has a sidewall defined by a right circular conical frustum between a circular base and a plane spaced apart from the base and oriented at an oblique angle to the base. A convex face portion of the lens extends from the sidewall and closes the hollow space within the lens.

3 Claims, 6 Drawing Sheets

LENS FOR LED TRAFFIC LIGHTS

FIELD OF THE INVENTION

The present invention relates to lenses for traffic lighting. In particular, the invention relates to lenses for traffic lights using an LED light source as compared to the traditional prior art incandescent bulbs.

BACKGROUND

A benefit of LED (light emitting diode) lighting is a significant reduction in power use for an equivalent light output, compared to incandescent lighting. The use of LED lighting in traffic lights, however, has led to the problem of unacceptable snow and ice build-up on the lens and consequently raised potential safety concerns. The reason for the snow build up is that there may not be sufficient heat generated by the LED lighting to melt any snow and ice that may have accumulated on the lens surface. In turn, this results in a visual impairment of the traffic light signal indication.

The comparative absence of the snow build-up problem with incandescent lighting has apparently depended on the fact that incandescent lighting generates thermal energy in the form of heat which is useful in melting snow and ice from the face of the lens. Since the advent of LED lighting, there has arisen an increased number of reported incidents of obstructed signal beacons due to the accumulation of snow and ice thereon. It has been particularly observed that the build-up of snow and/or ice on prior art LED traffic lights starts at the bottom of the LED signal beacon and progressively moves upward to obstruct the traffic light.

SUMMARY OF THE INVENTION

A lens, according to the present invention, has a sidewall defined by a hollow right circular conical frustum between a circular base and a plane spaced apart from the base and oriented at an oblique angle to the base. A convex face portion extends from the sidewall at the plane.

According to another embodiment, the sidewalls taper outwardly from the face portion to the circular base.

According to another embodiment, the length of the sidewall at the top is less than the adjacent lateral dimension of the cowl visor and the length of the sidewall at the bottom is greater than the adjacent lateral dimension of the cowl visor.

According to another embodiment, the lens has a flange extending radially outwardly from the circular base.

BRIEF DESCRIPTION OF THE DRAWINGS

In order that the invention may be more clearly understood, a preferred embodiment thereof will now be described in detail by way of example, with reference to the accompanying drawings, in which.

DESCRIPTION OF THE PREFERRED EMBODIMENTS

According to the present invention, a specialized lens is disclosed which is retrofitted or installed on an LED traffic light having an LED signal beacon 10 and a cowl visor 11. The lens is placed over the LED signal beacon 10 and, together with the cowl visor 11, assists in wholly or partially preventing snow build up thereon. In the case of partial obstruction, the traffic light nonetheless remains visible to the driver and therefore operational.

Figure 1A:
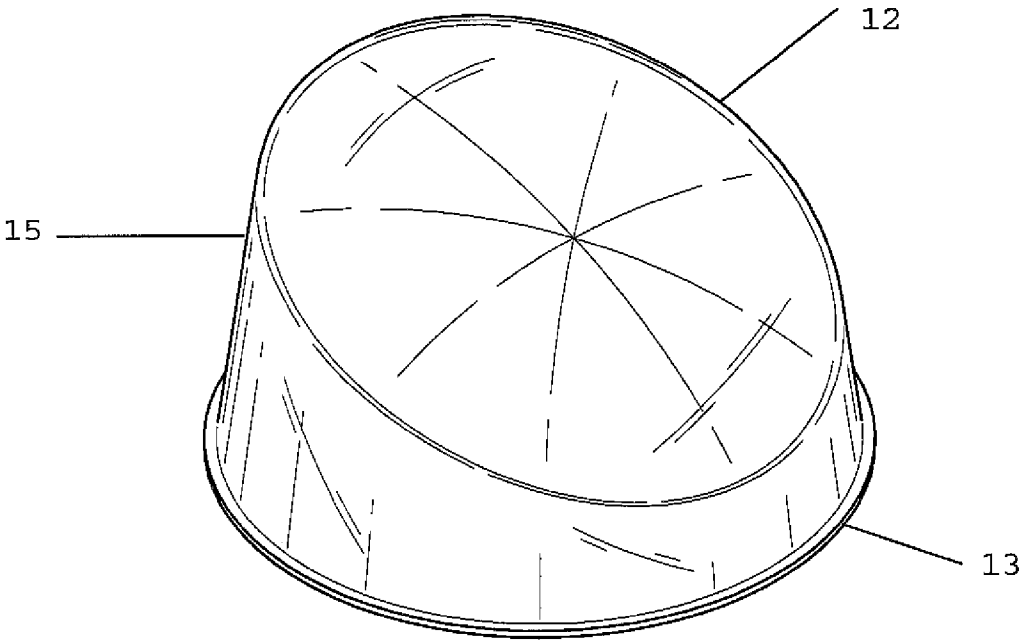
FIG. 1A is a perspective view of the lens, according to the present invention.
Figure 1B:
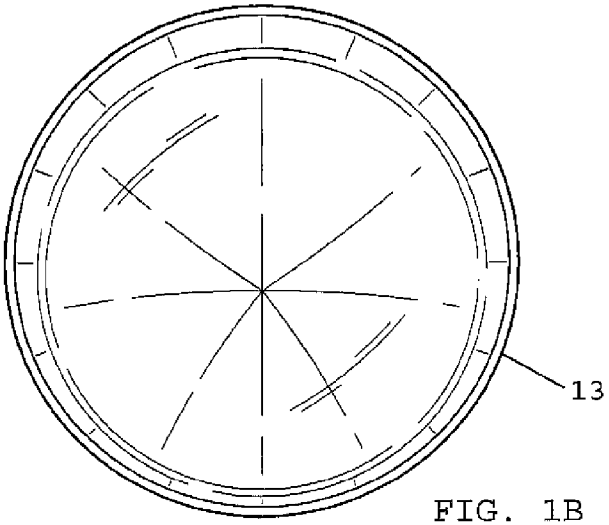
FIG. 1B is a top plan view of the lens of FIG. 1A.
Figure 1C:
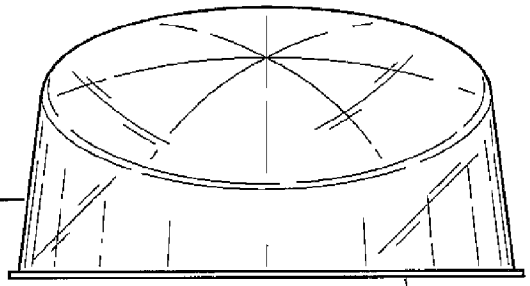
FIG. 1C is a front elevation view of the lens of FIG. 1A.
Figure 1D:
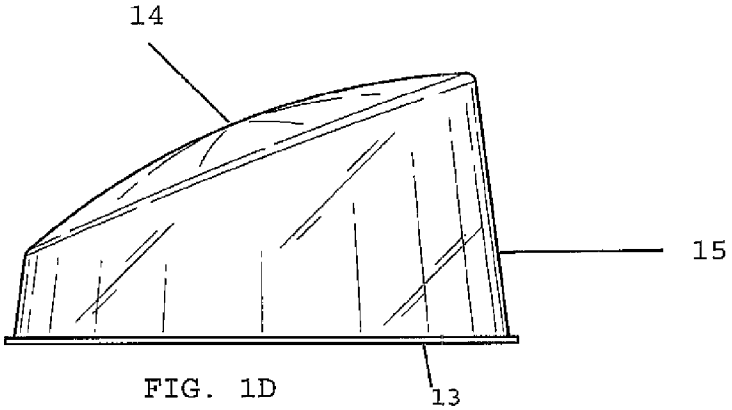
FIG. 1D is a left side elevation view of the lens of FIG. 1A.
Figure 1F:
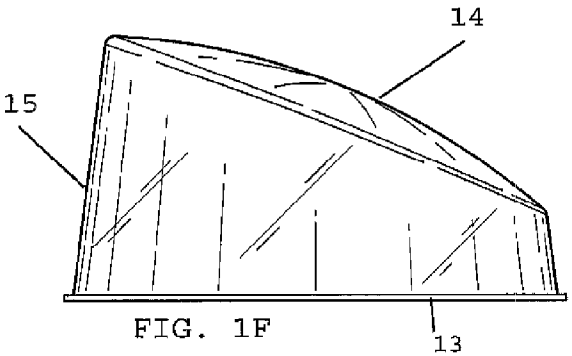
FIG. 1F is a right side elevation view of the lens of FIG. 1A.
Figure 1E:
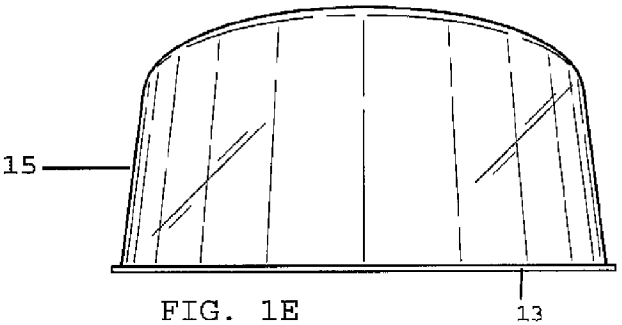
FIG. 1E is a rear elevation view of the lens of FIG. 1A.
Figure 1G:
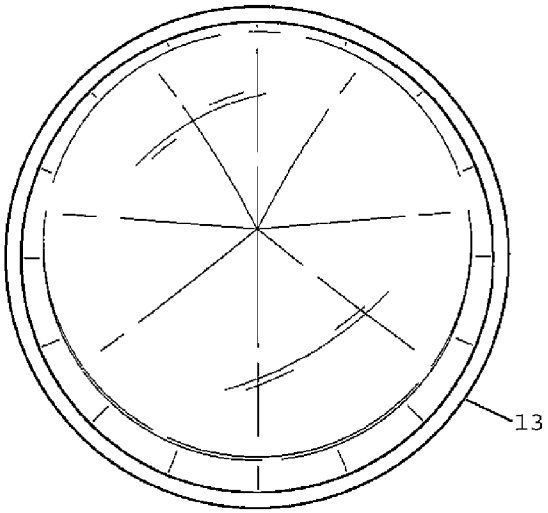
FIG. 1G is a bottom plan view of the lens of FIG. 1A.
Figure 2:
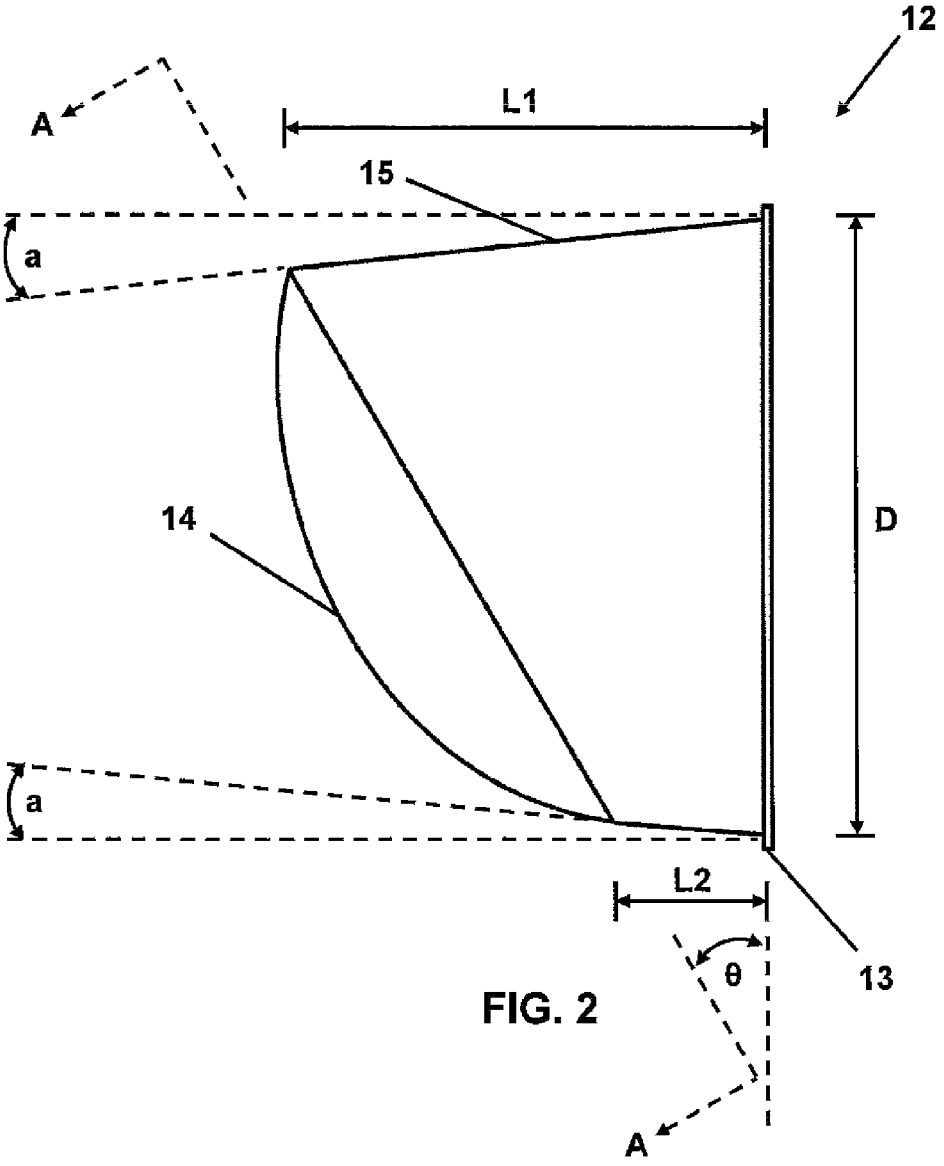
FIG. 2 is a schematic side profile view of the lens.

A preferred embodiment of the lens 12 according to the present invention is shown in the Figures. The shape of the lens 12 is defined by a right circular cone intersected along plane AA at an oblique angle by a convex shaped face portion 14 to form a non-parallel conical frustum, as shown in FIG. 2. At the opposing end of the lens 12 from the face portion 14 is a circular base, with a diameter D and a flange 13 extending radially outwardly from the lens 12. The lens 12 has a continuous side wall 15, between the flange 13 and the face portion 14, which is defined by the hollow frustum of the cone between the circular base and the plane AA.

Figure 3:
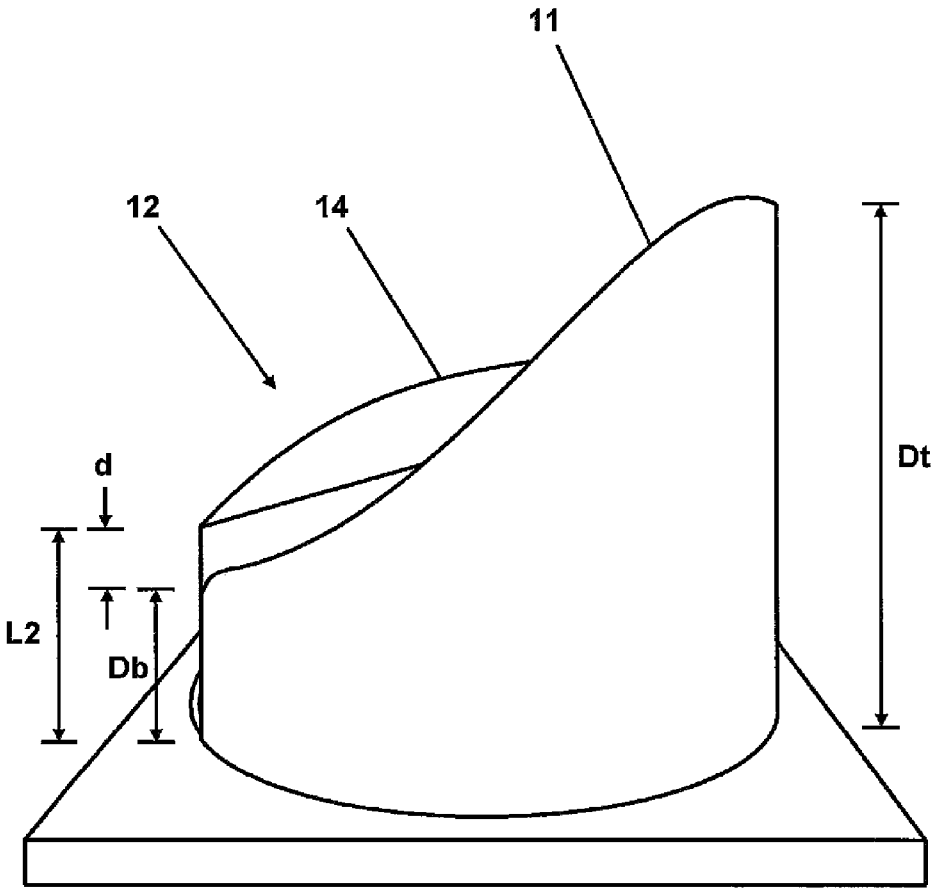
FIG. 3 is a side view of the lens installed on a traffic light.

Referring to FIGS. 2 and 3, the length L1 of the sidewall 15 of the lens 12 at the top is dimensioned to be less than the adjacent lateral dimension Dt of the cowl visor 11 to ensure that there is no protrusion of the lens 12 beyond the leading edge of the cowl visor 11. The length L2 of the sidewall 15 of the lens 12 at the bottom exceeds the adjacent lateral dimension Db of the cowl visor 11 at the bottom so that the bottom portion of the lens 12 protrudes a distance d outwardly beyond the cowl visor 11 at the bottom. The lateral distance L1 is greater than the lateral distance L2, thereby orienting the face portion of the lens 12 at an oblique angle to the flange 13 at the base of the lens 12.

Referring to FIG. 3, it can be seen that the face portion 14 of the lens 12 protrudes beyond the cowl visor 11 over approximately one half its bottom width.

Referring to FIG. 2, the lens 12 is tapered outwardly from the face portion 14 to the flange 13, at an angle a, which is preferably between 3° and 4° to ensure no physical interference between the lens 12 and the cowl visor 11.

The lens 12 forms an air cavity over the LED signal beacon 10 into which dissipates any heat generated by the LED lighting with the result that the surface temperature of the lens 12 is substantially identical to the temperature of the external environment. This assists in preventing snow and ice from adhering to the lens 12, thereby helping maintain visibility of the traffic light signal.

The convex face portion 14 of the lens 12 and its orientation at an oblique angle to the flange 13 at the base of the lens 12 offers streamlining against the elements borne by the wind and assists in redirecting the snow and ice approaching from all directions, or angles of contact, away from the face portion 14 of the lens 12. The downward re-direction of the elements is assisted by the angle θ of the plane AA, on which the face portion 14 is oriented. This orientation also maximizes the effect of the force of gravity to counteract any build-up of snow and ice on the face portion 14. Obstruction of the traffic signal by the accumulation of snow and ice on the inside bottom of the cowl visor 11 in prior art traffic signal installations is thus prevented or minimized.

The lens 12 is made translucent so as not to cause any optical distortion of the signal beacon and the convex surface additionally assists in reducing the amount of light that may be reflected directly by a vertical lens.

The dimensions of a preferred embodiment of a lens 12, according to the present invention, offered by way of example only, are as follows. They are with reference to a standard 12" diameter lens 12 and may be adjusted proportionately for other standard sizes, such as an 8" diameter lens 12.

D=11"

L1=5½"

L2=2"

θ=26°

Figure 4:
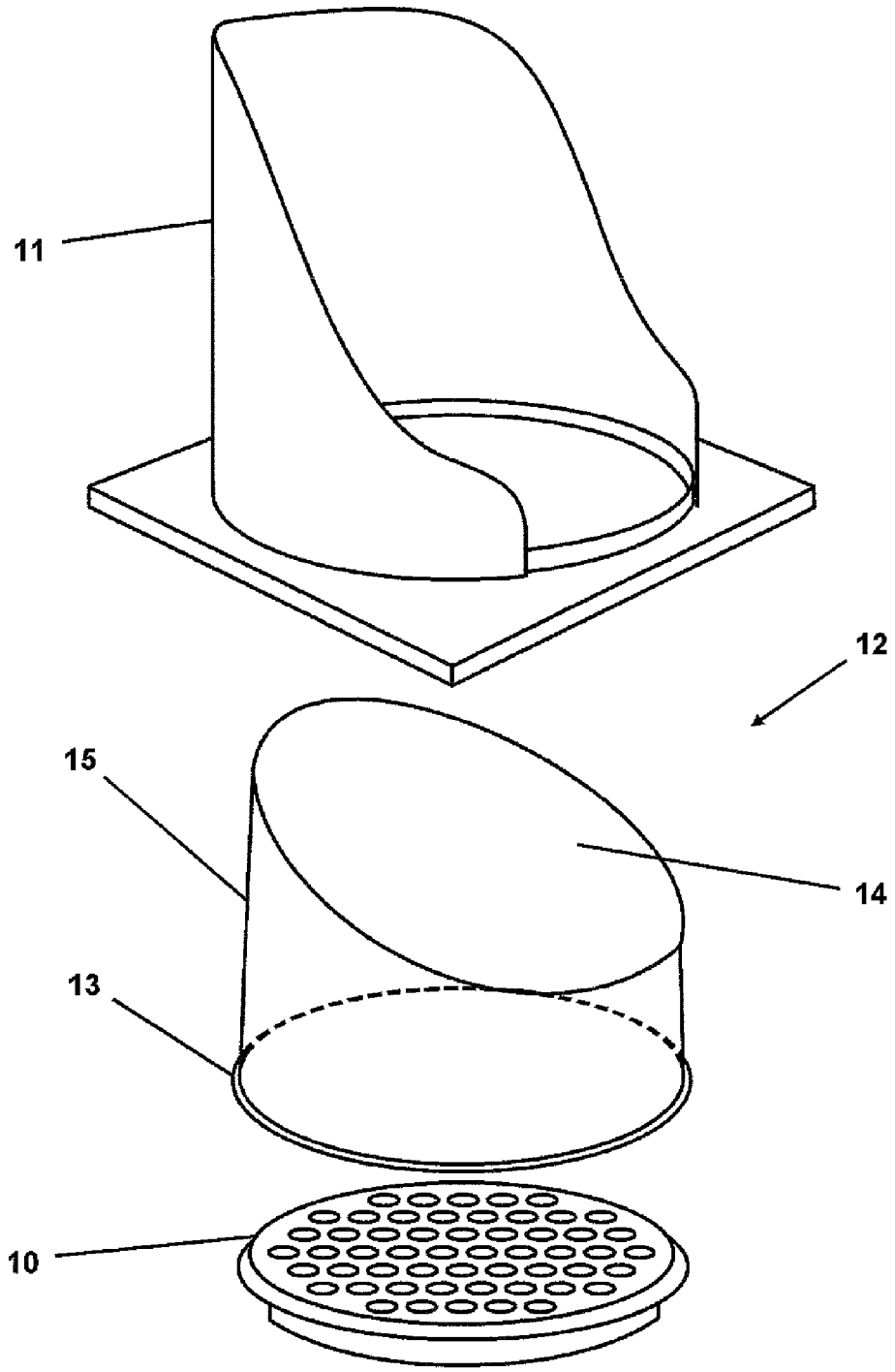
FIG. 4 is an exploded view of a traffic light assembly, wherein the lens is installed on a traffic light by way of retrofit, as described herein.

The lens 12 may be retrofitted on existing traffic light installations by installing the lens 12 over the pre-existing LED signal beacon 10, as shown in FIG. 4. An environmental gasket (not shown) should be provided between the adjacent surfaces of the traffic light and the flange 13 of the lens 12. Special fasteners may be required on the frame of the traffic light in order to secure the retrofitted assembly at the rear of the traffic light. The retrofit will result in raising the rear of the traffic light a distance equal to the thickness of the flange 13 of the lens 12 and any gaskets placed between the flange 13 and the traffic light. Accordingly, the fastener must be crimped to accommodate the resulting raise with reference to the frame.

Other advantages which are inherent to the invention are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A lens for a traffic signal having an LED signal beacon, a frame, and a cowl visor, the lens comprising:

a sidewall defined by a hollow right circular conical frustum between a circular base and a plane spaced apart from the base and oriented at an oblique angle to the base; and a convex face portion extending from the sidewall at the plane;

wherein the sidewall tapers outwardly from the face portion to the circular base; and wherein the lens and the traffic signal have a top and a bottom, and wherein the length of the sidewall of the lens at the top is less than the adjacent lateral dimension of the cowl visor and the length of the sidewall of the lens at the bottom is greater than the adjacent lateral dimension of the cowl visor.

2. The lens according to claim 1, wherein the lens has a flange extending radially outwardly from the circular base.

3. The lens according to claim 2, wherein the flange is secured between the LED signal beacon and the frame of the traffic signal to retain the lens in position over the LED signal beacon.

* * * * *